US007959092B2

(12) United States Patent
Nomura et al.

(10) Patent No.: US 7,959,092 B2
(45) Date of Patent: Jun. 14, 2011

(54) COATING MACHINE AND ROTARY ATOMIZING HEAD THEREOF

(75) Inventors: Takao Nomura, Aichi (JP); Shigeyoshi Inada, Aichi (JP); Takashi Katsumata, Aichi (JP); Satoshi Takeda, Aichi (JP)

(73) Assignee: Trinity Industrial Corporation, Aichi (JP)

( * ) Notice: Subject to any disclaimer, the term of this patent is extended or adjusted under 35 U.S.C. 154(b) by 842 days.

(21) Appl. No.: 11/569,509

(22) PCT Filed: Mar. 23, 2005

(86) PCT No.: PCT/JP2005/005193

§ 371 (c)(1),
(2), (4) Date: Feb. 28, 2007

(87) PCT Pub. No.: WO2005/115629

PCT Pub. Date: Dec. 8, 2005

(65) Prior Publication Data

US 2007/0240645 A1 Oct. 18, 2007

(30) Foreign Application Priority Data

May 25, 2004 (JP) ..... 2004-154183

(51) Int. Cl.
*B05B 3/10* (2006.01)

(52) U.S. Cl. ..... 239/224; 239/222.11; 239/223; 239/380

(58) Field of Classification Search ..... 239/223, 239/224, 142, 215, 216, 222–222.21, 380
See application file for complete search history.

(56) References Cited

U.S. PATENT DOCUMENTS 1,420,722 A * 6/1922 MacLachlan ..... 239/223
3,221,992 A * 12/1965 Sedlacsik, Jr. et al. ..... 239/703
4,749,586 A 6/1988 Bravet et al.
6,513,729 B2 * 2/2003 Ochiai et al. ..... 239/223

(Continued)

FOREIGN PATENT DOCUMENTS

GB 887450 1/1962

(Continued)

OTHER PUBLICATIONS

English language Abstract of JP 8-24719.

(Continued)

*Primary Examiner* — Christopher S Kim
(74) *Attorney, Agent, or Firm* — Greenblum & Bernstein P.L.C.

(57) ABSTRACT

A coating machine enables the inside of a paint chamber to be washed clean with less amount of use of thinner by increasing washing efficiency and is capable of forming a coating with uniform coating thickness by always uniformly jetting a paint over 360° about a rotary atomizing head and the rotary atomizing head of the coating machine. The coating machine includes the rotary atomizing head in which the paint chamber is formed in the clearance between an outer bell fitted to the tip of a tubular rotating shaft and an inner bell fitted to the front side of the outer bell. Fins agitating, in the paint chamber, a washing fluid supplied from a thin tubular nozzle inserted into the tubular rotating shaft are radially formed on the rear surface side of the inner bell. An annular paint groove temporarily accumulating the paint is formed in the inner surface of the rim part of the outer bell on which the paint jetted from the paint jetting holes formed at the peripheral surface part of the paint chamber is extended.

12 Claims, 7 Drawing Sheets

U.S. PATENT DOCUMENTS

| | | | |
|---|---|---|---|
| 7,014,713 | B2 | 3/2006 | Nakane |
| 7,156,045 | B2 | 1/2007 | Ueno et al. |
| 2002/0023971 | A1 | 2/2002 | Ochiai et al. |
| 2003/0010841 | A1 | 1/2003 | Kon |
| 2003/0094519 | A1 | 5/2003 | Van der Steur |

FOREIGN PATENT DOCUMENTS

| | | |
|---|---|---|
| JP | 57-42361 | 3/1982 |
| JP | 3-19548 | 2/1991 |
| JP | 8-024719 | 1/1996 |
| JP | 09-94489 | 4/1997 |
| JP | 10-099737 | 4/1998 |
| JP | 2002-224593 | 8/2002 |
| JP | 2005-137980 | 2/2005 |

OTHER PUBLICATIONS

English language Abstract of JP 57-42361.
English language Abstract of JP 2002-224593.
English language Abstract of JP 09-94489.
English language Abstract of JP 2005-137980.
U.S. Appl. No. 11/569,507 to Nomura et al., which was filed Nov. 22, 2006.
English language translation of Japanese Utility Model Publication No. JP 3-19548.

* cited by examiner

COATING MACHINE AND ROTARY ATOMIZING HEAD THEREOF

TECHNICAL FIELD

The present invention concerns a rotary atomizing type coating machine and a rotary atomizing head used therefor.

BACKGROUND ART

In an automobile coating line, since works of different coating colors are conveyed together, rotary atomizing electrostatic multi-color coating machines of supplying coating materials of respective colors selectively to a coating machine and conducting color-change coating with an optional coating color have been used.

FIG. 7 shows such an existent electrostatic coating machine 31 having a rotary atomizing head 33 driven rotationally by a built-in air motor 32.

In the rotary atomizing head 33, an inner bell 36 is attached to an outer bell 35 attached to the top end of a tubular rotary shaft 34 of the air motor 32, and a coating material chamber 37 is formed between the rear face of the inner bell 36 and the outer bell 35.

Then, a coating material of a color selected by a color-change device (not illustrated) is supplied through a fine tubular nozzle 38 inserted in the tubular rotary shaft 34 to the coating material chamber 37, flows out from a coating material discharge hole 39 penetrated in the peripheral surface of the coating material chamber 37 by a centrifugal force along the inner surface of a rim portion 40 of the outer bell 35 and atomized under rotation at an atomizing edge 41 formed at the top end thereof.

Patent Document 1: JP-A No. 9-94489

Patent Document 2: JP-A No. 2003-374909

According to this, when a coating material of a coating color for a preceding work is supplied from the fine tubular nozzle 38 while rotationally driving the coating material rotary atomizing head 33 by the air motor 32, the coating material flows into the coating material chamber 37 , hits against the rear face of the inner bell 36, is blown to the peripheral surface of the coating material chamber 37 centrifugally by the rotation thereof, flows out from the coating material discharge hole 39 to the rim portion 40 and atomized at the top end thereof.

Then, in a case where the coating color of a succeeding work is different, a cleaning fluid such as a thinner (cleaning fluid) and air is supplied from the fine tubular nozzle 38 to the rotary atomizing head 33 before reaching of the work to clean the coating material of the preceding color remaining in the coating machine 31 and then a coating material of a succeeding color is supplied.

By the way, reduction of VOC (volatile Organic Compounds) and $CO_2$ has been demanded recently in view of environments and, in a case of conducting color-change coating, color-change cleaning has to be conducted within a restricted period of time on every completion of the coating for the preceding work till reaching of the succeeding work and since color mixing is caused to result in coating failure in a case where the cleaning is insufficient, the amount of thinner used for cleaning can not be decreased extremely.

Particularly, since the thinner supplied from the fine tubular nozzle is jetted directly, the rear face of the inner bell 36 is cleaned easily. However, since the ceiling of the coating material 37 can not be cleaned unless the coating material chamber is filled with the thinner, the amount of use thereof can not be decreased.

Further, while the coating material supplied to the coating material chamber 37 flows out from the coating material discharge hole 39 penetrated in the peripheral surface thereof along the inner surface of the rim portion 40 of the outer bell 35 by a centrifugal force and atomized under rotation by the atomizing the 41 formed to the top end thereof, the coating material is not always supplied uniformly to each of the coating material discharge holes 39 formed in the peripheral direction when the centrifugal force exerts on the coating material in the coating material chamber 37.

Accordingly, the coating material is not discharged uniformly over 360° with the rotary atomizing head 33 as a center. While it is supplied in a greater or a smaller amount depending on the sites. Since the sites change at random with lapse of time and they are under a substantially uniform coating layer is formed entirely.

However, according to the experiment made by the inventor, it has been found that sites supplied with a larger amount and a smaller amount interfere to each other as a result of random change of them to sometimes result in sites where the coating layer is thick or thin although at a slight possibility.

DISCLOSURE OF THE INVENTION

Subject to be Solved by the Invention

Then, it is a technical subject of the present invention to at first improve the cleaning efficiency, and enable fine cleaning in the inside of a coating chamber with a small amount of a thinner to be used, and secondly jet out the coating material always uniformly over 360° with the rotary atomizing head as the center thereby forming a coating layer with no unevenness in the thickness.

Means for the Solution of the Subject

The present invention provides a coating machine having a rotary atomizing head with an inner bell being attached to an outer bell attached to the top end of a tubular rotary shaft, in which a coating material chamber is formed between the rear face of the inner bell and the outer bell, in which a coating material supplied from a fine tubular nozzle inserted through the tubular rotary shaft to the coating material chamber flows out from the coating material discharge hole formed to the peripheral surface of the coating material chamber along the inner surface of the rim portion of the outer bell and is atomized under rotation by an atomizing edge formed at the top end thereof wherein, fins for stirring a coating material or a cleaning fluid supplied from the fine tubular nozzle in the coating material chamber are disposed radially at the rear face of the inner bell, and an annular coating material groove is formed to the rim portion from the coating material discharging hole to the atomizing edge for temporarily accumulating a coating material flowing out from the coating material discharge hole.

Effect of the Invention

According to the coating machine of the invention, when a coating material is supplied from the fine tubular nozzle to the coating material chamber while rotating the rotary atomizing head, the coating material hits against the rear face of the rotating inner bell, the blown out to the periphery by the centrifugal force thereof, flows out from the coating material discharge hole penetrated in the peripheral surface of the coating material chamber along the inner surface of the rim portion of the outer bell and atomized under rotation by the atomizing edge formed at the top end thereof.

In this case, since the annular coating material groove for temporarily accumulating the coating material flowing out of the coating material discharge formed is hold to the rim portion from the coating material discharge hole to the atomizing edge, the coating material flowing along the rim portion is temporarily accumulated in the coating material groove and then flows therefrom under overflow to the atomizing edge.

Accordingly, even in a case where the coating material flowing out of the coating material discharge hole is not uniform over 360° depending on the behavior of the coating material in the coating material chamber, since it is once accumulated in the coating material groove and undergoes the centrifugal force, it is accumulated uniformity over the entire circumference of the coating material groove, and can flow out uniformly over 360° around the rotary atomizing head as the center when it is overflows out of the coating material groove to provide an excellent effect capable of forming a coating layer with no unevenness in the thickness.

Further, since fins for stirring the coating material or the cleaning fluid supplied to the coating material are formed at the rear face of the inner bell, the coating material is effectively stirred and mixed upon coating in the coating material chamber. Particularly, this is extremely effective, for example, in a case of supplying plural kinds of coating materials such as a two-component mixed coating material, coating material ingredients are made uniform and, accordingly, the quality of the coating material can be made uniform Then, in a case of supplying a cleaning fluid such as a thinner while rotating the rotary atomizing head after the completion of the coating, since the cleaning fluid is stirred in the coating material chamber, the ceiling side of the coating material chamber can be cleaned without completely filling it in the coating material chamber and the amount of the cleaning fluid to be used can be decreased.

Particularly, in a case where the fin has a tapered surface whose height increases gradually from forward to backward in view of the rotational direction thereof, since the cleaning fluid supplied at the rear face of the inner bell is splashed at the tapered surface of the fin toward the ceiling of the coating material, the inside of the coating chamber can be cleaned uniformly with little amount of fluid.

BEST MODE FOR CARRYING OUT THE INVENTION

In accordance with the embodiment, objects of improving the cleaning efficiency thereby capable of washing the inside of the coating material chamber clean with a small amount of a thinner to be used, and discharging a coating material always uniformly over 360° around the rotary atomizing head as a center to form a coating layer with no unevenness in the thickness has been attained in an extremely simple constitution.

FIG. 1 is an explanatory view showing an example of a coating machine according to the present invention, FIG. 2 is a horizontal cross sectional view and a side elevational view showing a main portion thereof, FIG. 3 is an assembled view for a rotary atomizing head according to the invention, FIG. 4 is an explanatory view showing other embodiment, FIG. 5 is an explanatory view showing other embodiment, and FIG. 6 is an explanatory view showing a further embodiment.

EMBODIMENT 1

A coating machine 1 shown in FIG. 1 is a center feed type rotary atomizing electrostatic coating machine having a rotary atomizing head 3 driven rotationally by a build-in air motor 2 for depositing a coating material supplied from fine tubular nozzles 5 inserted in a tubular rotary shaft 4 of the air motor 2 to a work by an electrostatic force.

The rotary atomizing head 31 is adapted such that an inner bell 7 is attached to an outer bell 6, a coating material chamber 8 is formed between the rear face of the inner bell and the outer bell, the coating material supplied from the fine tubular nozzle 5 inserted in the tubular rotary shaft 4 to the coating material chamber 8 is flown out from the coating material discharge holes 9 formed to the peripheral surface of the coating material chamber 8 along the inner surface of the rim portion 6R of the outer bell 6 and atomized under rotation by an atomizing edge 6E formed at the top end thereof.

Fins 10 for stirring the cleaning fluid supplied from the fine tubular nozzle S in the coating material chamber 8 are disposed radially at the rear face of the inner bell 7. Each of the fins 10 is formed as a curved surface that curves in the rotational direction as it recedes from the center of the inner bell 7 and a tapered surface 10*a* gradually increasing the height from the forward to the backward in view of the rotational direction (shown by arrow in FIG. 2) is formed on the frontal side thereof.

Accordingly, each of the coating material and the cleaning fluid supplied from the fine tubular nozzle 5 to the rear face of the inner bell 7 is splashed partially by the fins 10 of the rotating inner bell 7 in the direction perpendicular to the tapered surface 10*a* and stirred in the coating material chamber 8.

In this embodiment, the inner bell 7 is formed of a material different from that of the outer bell 6, for example, a resilient high molecular polyethylene or a hard plastic such as a PEEK material.

Then, the fin is formed so as to protrude outward of the outer peripheral surface of the inner bell 7, the top end 10*b* is fitted into a fitting hole 6a formed in the inner surface of the outer bell 6 to integrate the outer bell 6 and the inner bell 7.

Thus, an annular slit as a coating material discharge hole 9 is formed between the outer bell 6 and the inner bell 7, which not only makes the cutting fabrication unnecessary but also the size of the hole can be set freely by optionally designing the slit width compared with the case of engraving a number of small diameter holes in an annular shape.

Further, in a case of engraving a number of small diameter holes, since the coating material is accelerated upon passing the small diameter hole and hits against the rim portion 6R, it involves a problem that a wear intent extended radially from the small diameter hole to the atomizing edge 6E is formed with the coating material but since the coating material is discharged uniformly by making the coating material discharge hole 9 slitwise, such wear indent is not formed.

Further, an annular coating material groove 11 for temporarily accumulating the coating material flown out of the coating material discharge hole 9 is formed to the rim portion 6R from the coating material discharge holes 9 to the atomizing edge 6E, Thus, the coating material flowing along the rim portion 5R is temporarily accumulated in the coating material groove 11 before reaching the atomizing edge 6E and then flows therefrom to the atomizing edge 6E in an over flow manner.

A constitutional example of the invention is as has been described above and the operation thereof is to be described. When a coating material is supplied from the fine tubular nozzle 5 while rotating the rotary atomizing head 3 by the air motor 2 of the coating machine 1, it is blown out partially to the peripheral surface of the coating material chamber 8 under the centrifugal force by a rotating inner bell 7 and partially blown out by the fins of the rotating inner bell 7 in the direction perpendicular to the tapered surface 10*a*, and deposited to the ceiling surface of the coating material chamber 8, and flows toward the peripheral surface.

Since the annular slit as the coating material discharge hole 9 is formed between the outer bell 6 and the inner bell 7 at the peripheral surface of the coating material chamber 8, the coating material flows out from the coating material discharge hole 9 along the inner surface of the rim portion 6R of the outer bell 6, is accumulated temporarily in the coating material groove 1 before reaching the atomizing edge 6E and flows therefrom to the atomizing edge E in an overflow manner.

Accordingly, even when the coating material flowing out of the coating material discharge hole 9 is not uniform entirely depending on the behavior of the coating material in the coating material chamber 8, since the centrifugal force exerts when the coating material is once accumulated in the coating material groove 11 and it is accumulated uniformly over the entire periphery of the coating material groove 11, it can be flown out uniformly over the direction of 360° upon overflow from the coating material groove 11 and can form a coating layer with no unevenness in the thickness.

Further, since fins 10 are formed at the rear face of the inner bell 7 in the coating material chamber 8, the coating material is stirred and mixed effectively in the coating material chamber 8 during coating and the coating material ingredients are made uniform extremely effectively, for example, in a case of supplying plural kinds of coating materials such as a two-component mixed coating material and, accordingly, the quality of the coating layer can be made uniform.

Further, upon color-change cleaning, when a cleaning fluid such as a thinner is supplied from the fine tubular nozzle 5 while rotating the rotary atomizing head 3, it is partially splashed directly to the peripheral surface of the coating material chamber 8 under the effect of the centrifugal force by the rotating inner bell 7, while partially splashed in the direction perpendicular to the tapered surface 10*a* by the fins 10 of the rotating inner bell 7 and deposited to the ceiling surface of the coating material chamber, 8 and flows to the peripheral surface like in the case of the coating material.

As described above, since the cleaning fluid is stirred by the fins 10, even when the cleaning fluid is not completely filled in the coating material chamber 8, the coating material chamber 8 can be cleaned thoroughly as far as the ceiling surface, so that the amount of the cleaning fluid to be used can be decreased outstandingly Then, the cleaning fluid flows out from the annular slit as the coating material discharge hole 9 formed between the outer rim 6 and the inner bell 7 along the inner surface of the rim portion 6R of the outer bell 6 to clean the rim portion 6R, and is accumulated temporarily in the coating material groove 1 to clean the inside of the coating material groove 11 and, further, clean in an overflowing state therefrom as far as the atomizing edge 6E.

As has been described above, according to this embodiment, since the cleaning fluid supplied to the coating material chamber 8 is stirred by the fins 10 in the coating material chamber 8, the cleaning efficiency is improved and the inside of the coating material chamber 8 can be washed clean with a small amount of the thinner used.

Further, since the annular coating material groove 11 is formed to the rim portion 6R, the coating material is applied with the centrifugal force in a state accumulated in the coating material groove 11 and then caused to overflow and the coating material can be jetted out always uniformly over 360° around the rotary atomizing head 3 as a center to form a coating layer with no unevenness in the thickness of the coating layer.

EMBODIMENT 2

FIG. 4(*a*) is a side elevational view showing another example, FIG. 4(*b*) is a plan view of an inner bell in which portions in common with FIG. 1 to FIG. 3 carry same reference numerals for which detailed descriptions are to be omitted.

In this embodiment, fins 21 are formed as a crosswise propeller shape each extending from the center to the outside of the inner bell 7, and serve also as a bracket for attaching the inner bell 7 to an outer bell 6.

That is, the fin 21 is formed such that the top end thereof is raised being spaced above the rear face of the inner bell 7 and the cross section thereof has a wing-like shape formed with a tapered surface 21*a* gradually increasing the height of the upper surface from forward to backward in view of the rotational direction.

Further, in the outer bell 6, a fitting hole 6a is formed at a position a formed in the inner surface of the outer bell 6 corresponding to the top end of the fin 21, so that the inner bell 7 can be attached to the outer bell 6 by way of the fin 21.

Thus, the inner bell 7 is supported in a state being raised in the space of the coating material chamber 8, and an annular slit as the coating material discharge hole 22 is formed over the entire outer periphery thereof relative to the outer bell 6.

Then, in this embodiment, a peripheral end 7*a* of the inner bell 7 extends in the annular coating material groove 23 formed in the rim portion 6R of the outer bell 6, and a gap between the coating material groove 23 and the peripheral end 7*a* defines a coating material discharge hole 22.

Accordingly, also in this embodiment, when the coating material is supplied to the fine tubular nozzle 5 while rotating the rotary atomizing head 3, it is partially deposited to the rotating inner bell 7 and splashed directly by the centrifugal force to the peripheral surface of the coating material chamber 8 and splashed partially in the direction perpendicular to the tapered surface 21*a* by the rotating fin 21 and deposited to the ceiling surface of the coating material chamber 8, and flows toward the peripheral surface.

Then, the coating material flows out along the inner surface of the rim portion 6R of the outer bell 6, is accumulated temporarily in the coating material groove 23 upon passage through the coating material discharge hole 22 and then flows therefrom in an overflow state to the atomizing edge 6E.

Since the coating material is applied with the centrifugal force upon accumulation in the coating material groove 23 and accumulated uniformly over the entire periphery thereof, it can be flown out uniformly over the 360° direction upon overflow from the coating material groove 23 to form a coating layer with no unevenness in the thickness.

Further, when a cleaning fluid such as a thinner is supplied from the fine tubular nozzle 5 upon color-change cleaning, it is partially deposited to the rotating inner bell 7 , flows by the centrifugal force along the rear face thereof, is splashed to the peripheral surface of the coating material chamber 8 while cleaning the rear face and, partially, splashed in the perpendicular direction to the tapered surface 21*a* by the fin 21 of the rotating inner bell 7 and deposited to the ceiling surface, and then flows to the peripheral surface in the same manner as in the case of the coating material.

Accordingly, even when the coating liquid is not completely filled in the coating material chamber 8, it can clean thoroughly as far as the ceiling surface of the coating material chamber 8 and the amount of the cooling liquid to be used can be decreased outstandingly.

Then, since the cleaning fluid flows into the coating material groove 23 upon passage through the coating material discharge hole 22 along the inner surface of the rim portion 6R of the outer bell 6 and, further, overflows therefrom and reaches the atomizing edge 6E, it cleans the portions described above.

EMBODIMENT 3

Further, FIG. 5(*a*) is a side elevational view showing other embodiment and FIG. 5(*b*) is a horizontal cross sectional view of a rotary atomizing head.

In this embodiment, the fins 24 are formed into a propeller-shape, each end of the rotational center thereof is attached to the inner bell 7 and the outer top end thereof is formed being spaced apart from the outer bell 6.

Further, a coating material discharge port 25 formed by engraving a number of small diameter holes in an annular shape is formed to the outer periphery is at the bottom of the coating material chamber 8 (outer periphery of the inner bell) and a coating material groove 26 for temporarily accumulating the coating material flowing out of the coating material discharge port 25 is formed to the rim portion 6R of the outer bell 6.

Also in this case, the coating layer can be made uniform and the cleaning efficiency can be improved.

EMBODIMENT 4

Further, FIG. 6(*a*) is a side elevational view showing a still further embodiment and FIG. 6(*b*) is a horizontal cross sectional view of a rotary atomizing head.

In this embodiment, fins are formed into a propeller shape in which each outer end thereof is secured to the outer bell 6 forming the inner wall of the coating material chamber 8 and the end on the side of the rotational center is formed being apart from the inner bell 7.

Further, a coating material discharge port 25 formed by engraving a number of small diameter holes in an annular state is formed to the outer circumference of the bottom of the coating material chamber 8 (outer periphery of the inner bell 7), and a coating material groove 26 is formed to the rim portion 6R of the outer bell 6 for temporarily accumulating the coating material flowing out of the coating material discharge port 25.

Also in this embodiment, the coating layer can be made uniform to improve the cleaning efficiency.

INDUSTRIAL APPLICABILITY

The present invention is suitable for use in a rotary atomizing coating machine which is used in a coating line which requires high quality coating film and in which works of different coating colors are transported together such as a coating line for automobile bodies.

DESCRIPTION OF REFERENCES

Figure 1:
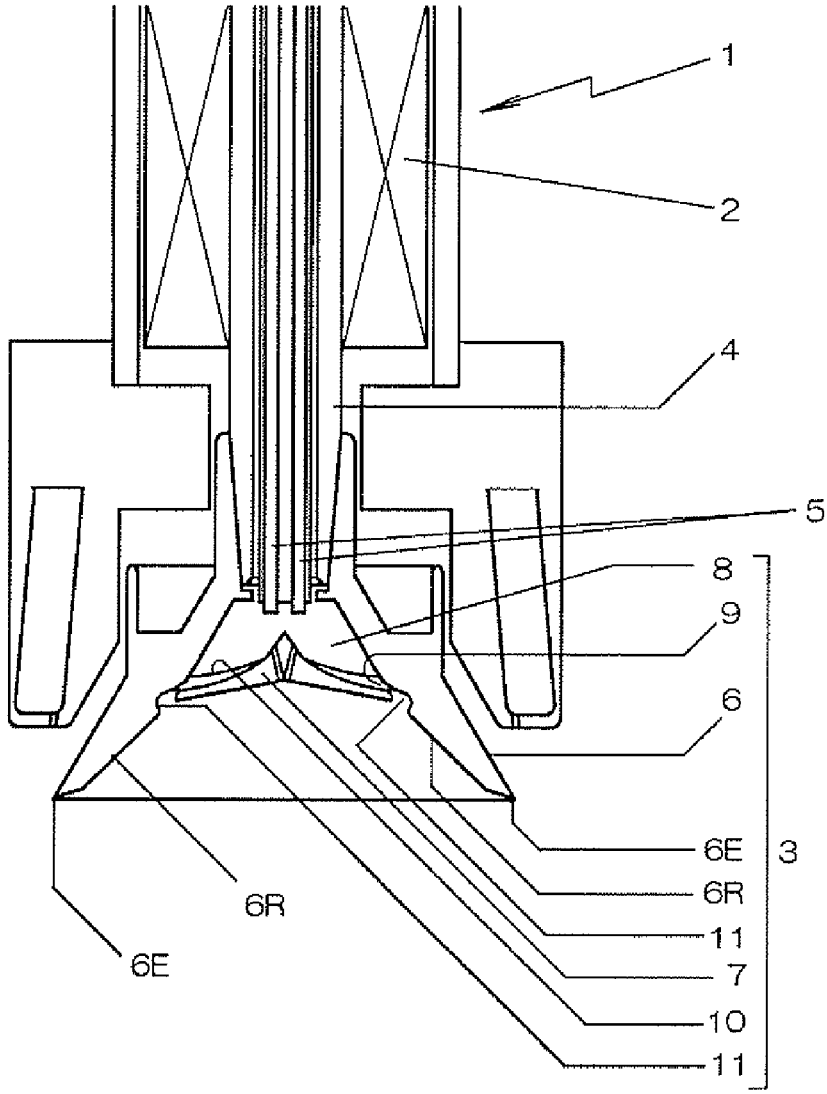
[FIG. 1] is an explanatory view showing a coating machine according to the invention.
Figure 2A:
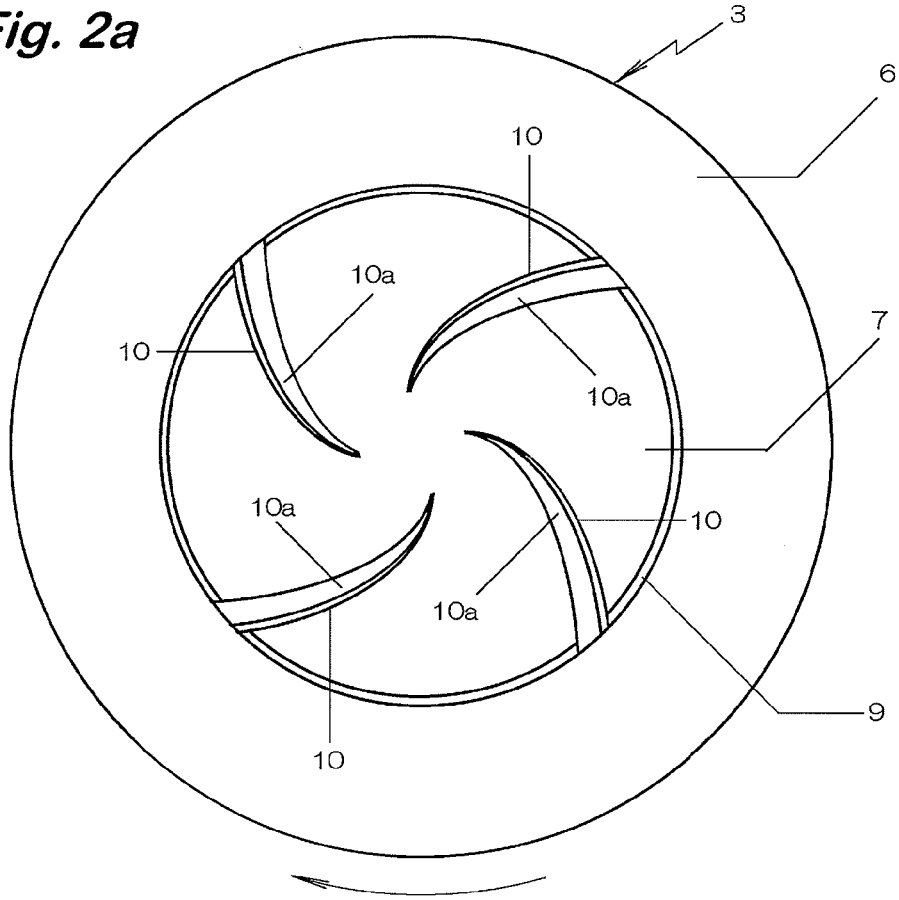
[FIG. 2] is a horizontal cross sectional view and a side elevational view showing a main portion of the invention.
Figure 2B:
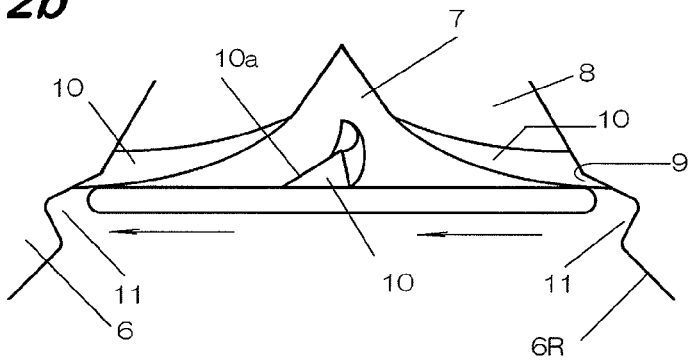
Figure 3A:
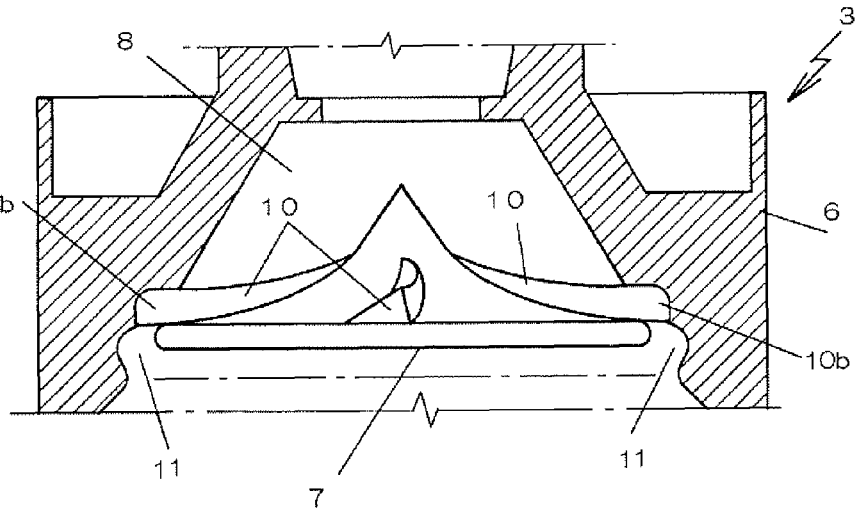
[FIG. 3] is an assembled view of a rotary atomizing head according to the invention.
Figure 3B:
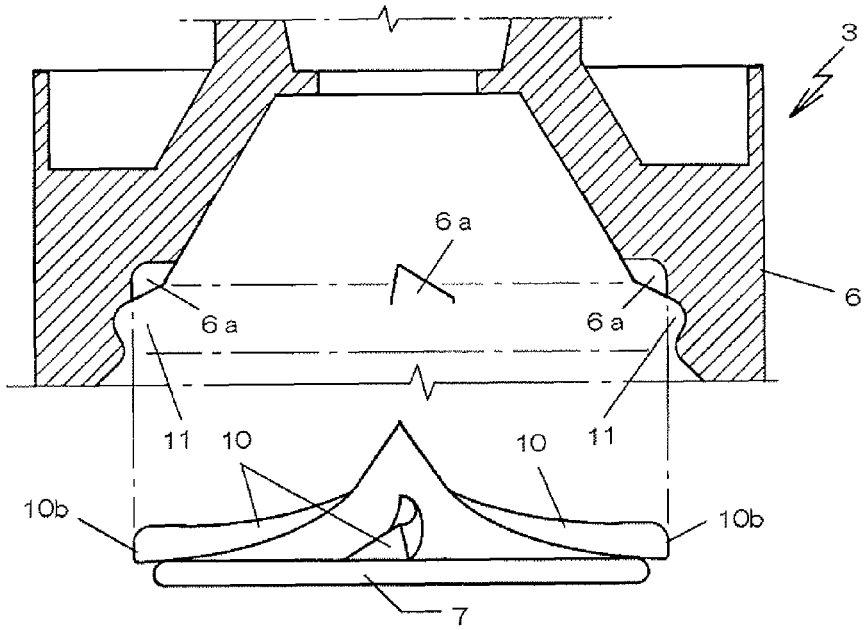
Figure 4A:
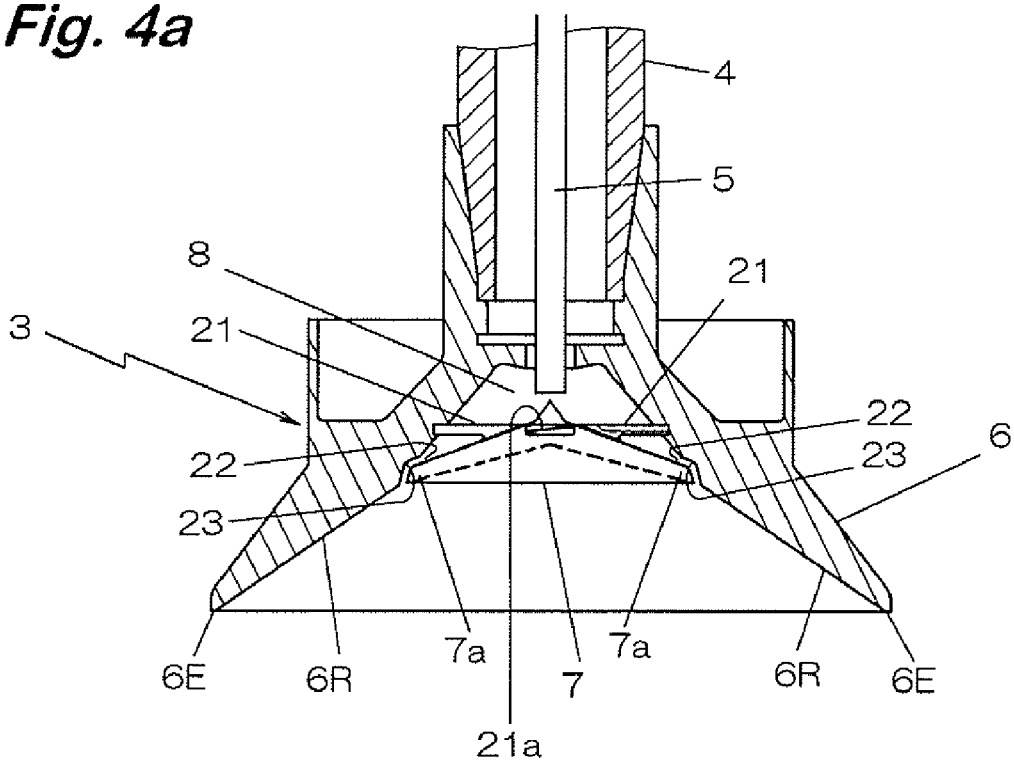
[FIG. 4] is an explanatory view showing other embodiment.
Figure 4B:
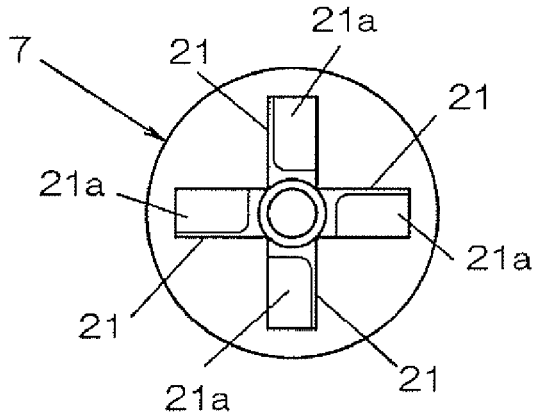
Figure 5A:
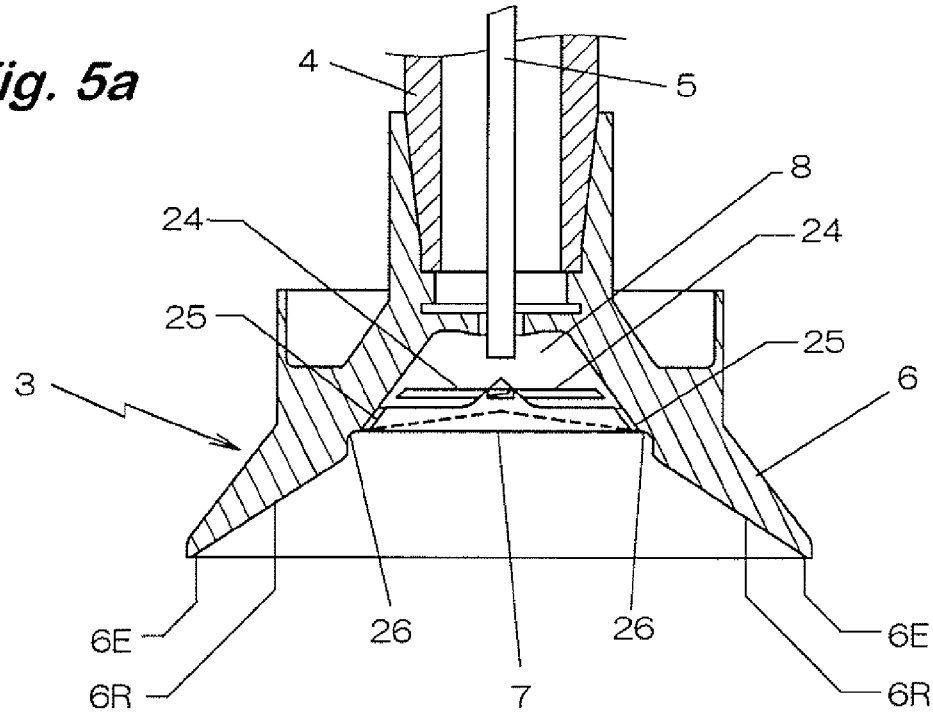
[FIG. 5] is an explanatory view showing other embodiment.
Figure 5B:
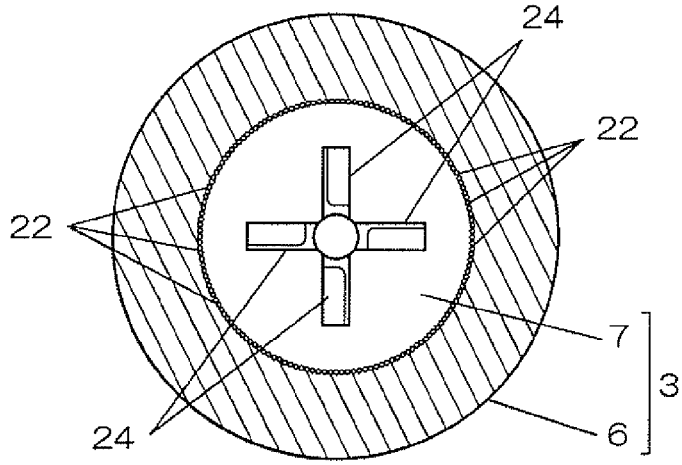
Figure 6A:
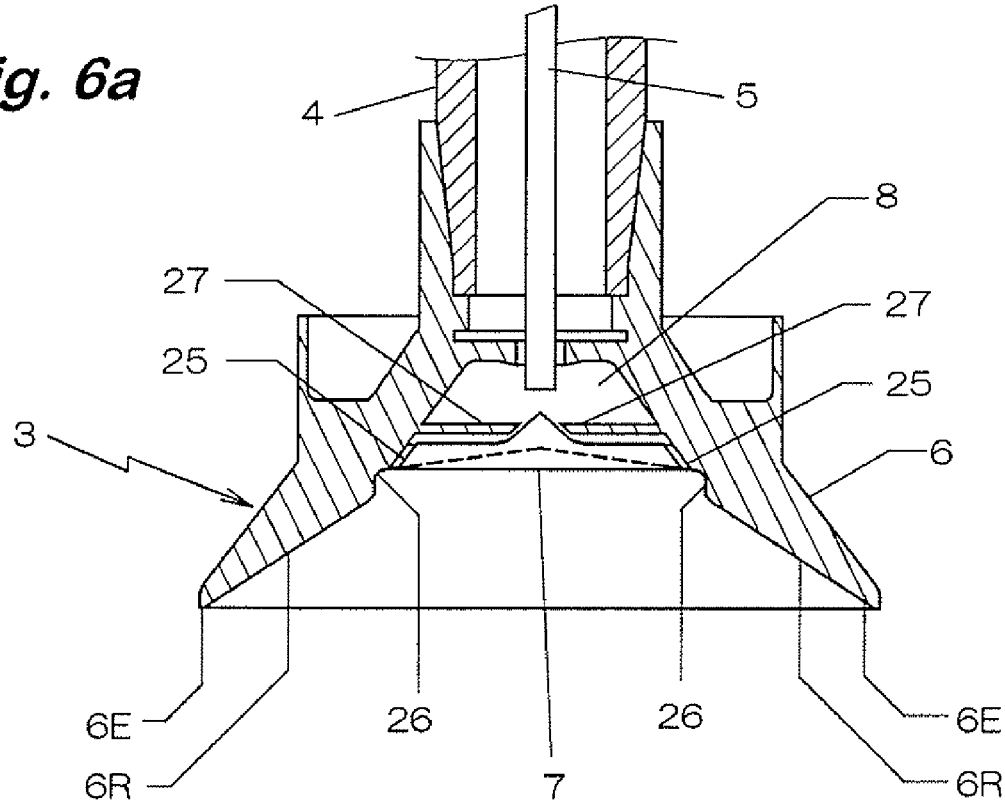
[FIG. 6] is an explanatory view showing other embodiment.
Figure 6B:
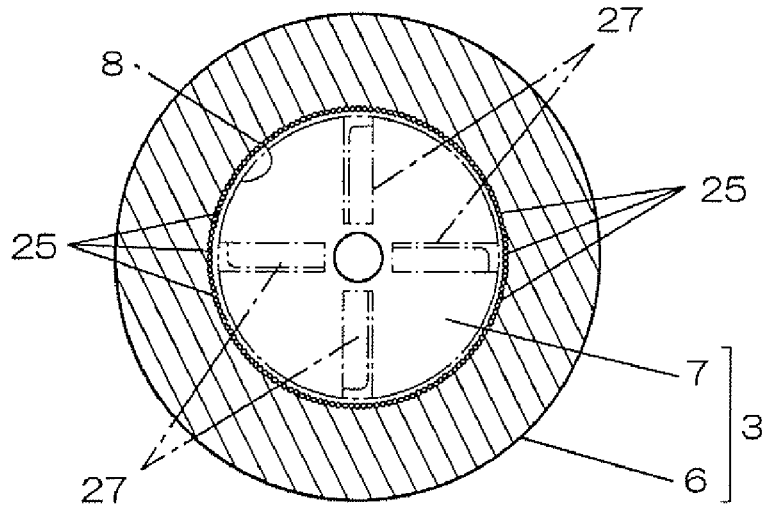
Figure 7:
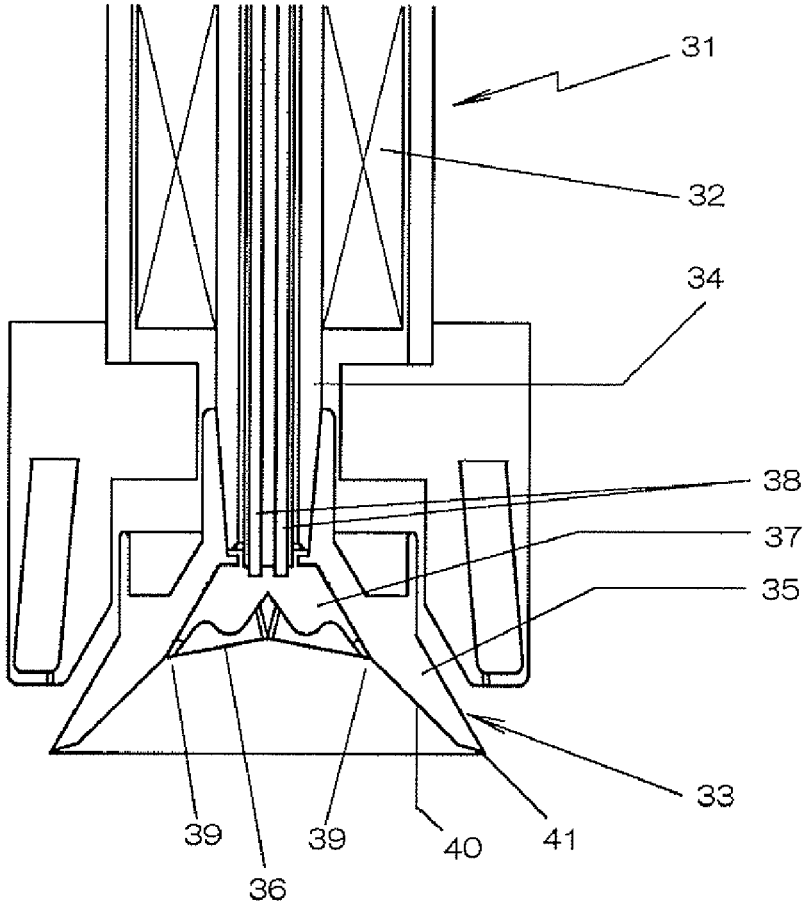
Fig. 7 ( prior art )
[FIG. 7] is an explanatory view showing an existent apparatus.

1 coating machine
3 rotary atomizing head
4 tubular rotary shaft
5 fine tubular nozzle
6 outer bell
6R ring portion
6E atomizing edge
6*a* fitting hole
7 inner bell
8 coating material chamber
9 coating material discharge hole
10 fin
10*a* tapered surface
11 coating material groove

The invention claimed is:

1. A rotary atomizing head for a coating machine, the rotary atomizing head comprising:

an inner bell;

an outer bell, the inner bell being attached to and positioned within the outer bell, and the outer bell being attachable to an end of a tubular rotary shaft of the coating machine;

a coating material chamber formed between a rear face of the inner bell and the outer bell, the coating material chamber being supplied with coating material such that a centrifugal force causes the coating material to flow out from a coating material discharge that penetrates a periphery of the coating material chamber and along an inner surface of a ring portion of the outer bell, wherein the coating material is atomized under rotation by an atomizing edge formed at an end of the ring portion of the outer bell; and fins configured to stir the coating material within the coating material chamber, the fins being disposed radially at a rear face of the inner bell, and the fins having tapered surfaces increasing in height gradually from forward to backward with respect to a rotational direction of the fins.

2. A rotary atomizing head according to claim 1, wherein the coating material discharge hole comprises an annular slit formed between the outer bell and the inner bell.

3. A rotary atomizing head according to claim 1, wherein each of the fins is formed into a curved surface that curves in a rotational direction as each of the fins recedes from the center of the inner bell.

4. A rotary atomizing head according to claim 1, wherein the fins are formed into a propeller shape and secured to one or both of the inner bell and the outer bell.

5. A rotary atomizing head according to claim 1, wherein the fins are formed into a propeller shape and both ends of each are secured to the inner bell and the outer bell respectively, so as to attach the inner bell to the outer bell.

6. A rotary atomizing head for a coating machine, the rotary atomizing head comprising:

an inner bell;

an outer bell, the inner bell being attached to and positioned within the outer bell, and the outer bell being attachable to an end of a tubular rotary shaft of the coating machine;

a coating material chamber formed between a rear face of the inner bell and the outer bell, the coating material chamber being supplied with coating material such that a centrifugal force causes the coating material to flow out from a coating material discharge hole formed along an inner surface of a ring portion of the outer bell so as to provide a passage between the inner surface of the ring portion and a peripheral edge of the inner bell, wherein the coating material is atomized under rotation by an atomizing edge formed at an end of the ring portion of the outer bell;

fins configured to stir the coating material within the coating material chamber, the fins being disposed radially at a rear face of the inner bell, and the fins having tapered surfaces increasing in height gradually from forward to backward with respect to a rotational direction of the fins; and an annular coating material groove that temporarily accumulates the coating material flowing out from the coating material discharge hole, wherein the annular coating material groove is formed on the ring portion between the coating material discharge hole and atomizing edge.

7. A rotary atomizing head according to claim 6, wherein the coating material discharge hole comprises an annular slit formed between the outer bell and the inner bell.

8. A rotary atomizing head according to claim 6, wherein a top end of the fin formed to the inner bell is fitted into a fitting hole formed to the inner surface of the outer bell to integrate the outer bell and the inner bell.

9. A rotary atomizing head according to claim 6, wherein each of the fins is formed into a curved surface that curves in a rotational direction as each of the fins recedes from the center of the inner bell.

10. A rotary atomizing head according to claim 6 wherein the fins are formed into a propeller shape and secured to one or both of the inner bell and the outer bell.

11. A rotary atomizing head according to claim 6, wherein the fins are formed into a propeller shape and secured to the inner bell and the outer bell respectively, so as to attach the inner bell to the outer bell.

12. A coating machine, comprising:

a tubular rotary shaft;

a tubular nozzle inserted through the tubular rotary shaft; and a rotary atomizing head having an inner bell and an outer bell, the inner bell being attached to and positioned within the outer bell, the outer bell being attached to an end of the tubular rotary shaft, the rotary atomizing head having a coating material chamber formed between a rear face of the inner bell and the outer bell, the tubular nozzle configured to supply a coating material to the coating material chamber such that the coating material flows out from a coating material discharge hole formed along an inner surface of a ring portion of the outer bell so as to provide a passage between the inner surface of the ring portion and a peripheral edge of the inner bell, wherein the coating material is atomized under rotation by an atomizing edge formed at an end of the ring portion of the outer bell, fins configured to stir the coating material supplied from the tubular nozzle in the coating material chamber, the fins being disposed radially at the rear face of the inner bell, and the fins having tapered surfaces increasing in height gradually from forward to backward with respect to a rotational direction of the fins, and an annular coating material groove that temporarily accumulates the coating material flowing out from the coating material discharge hole, wherein the annular coating material groove is formed on the ring portion between the coating material discharge hole and atomizing edge.

* * * * *